US006603431B2

(12) United States Patent
Talvitie et al.

(10) Patent No.: US 6,603,431 B2
(45) Date of Patent: Aug. 5, 2003

(54) MOBILE STATION AND ANTENNA ARRANGEMENT IN MOBILE STATION

(75) Inventors: Olli Talvitie, Tampere (FI); Saku Lahti, Kämmenniemi (FI)

(73) Assignee: Nokia Mobile Phones Ltd., Espoo (FI)

( * ) Notice: Subject to any disclaimer, the term of this patent is extended or adjusted under 35 U.S.C. 154(b) by 0 days.

(21) Appl. No.: 09/939,313

(22) Filed: Aug. 24, 2001

(65) Prior Publication Data

US 2002/0047807 A1 Apr. 25, 2002

(30) Foreign Application Priority Data

Aug. 29, 2000 (FI) ..... 20001903

(51) Int. Cl.[7] ..... H01Q 1/38
(52) U.S. Cl. ..... 343/702
(58) Field of Search ..... 343/702, 741, 343/700 MS; 455/90, 89, 575

(56) References Cited

U.S. PATENT DOCUMENTS 4,679,233 A 7/1987 Richardson et al. ..... 379/433
5,819,163 A 10/1998 Tsukamoto et al. ..... 455/90
5,986,614 A 11/1999 Suesada et al. ..... 343/752
6,236,368 B1 * 5/2001 Johson ..... 343/702

FOREIGN PATENT DOCUMENTS

| | | |
|---|---|---|
| EP | 0924793 A2 | 6/1999 |
| JP | 11-225011 | 8/1999 |
| WO | WO 97/47054 | 12/1997 |
| WO | WO 00/38475 | 6/2000 |

* cited by examiner

*Primary Examiner*—James Clinger
(74) *Attorney, Agent, or Firm*—Perman & Green, LLP

(57) ABSTRACT

A mobile station and an antenna arrangement for a mobile station, comprising an integrated antenna, an antenna ground plane and an antenna raising component arranged to keep the antenna at a determined height in respect of the ground plane. The antenna, the antenna ground plane and the antenna raising component are arranged in a space shared with a speaker of the mobile station. The antenna is substantially higher than the space between a back cover and a circuit board in the mobile station.

7 Claims, 2 Drawing Sheets

MOBILE STATION AND ANTENNA ARRANGEMENT IN MOBILE STATION

BACKGROUND OF THE INVENTION

1. Field of the Invention

The invention relates to a mobile station comprising an integrated antenna, an antenna ground plane and an antenna raising component arranged to keep the antenna at a determined height in respect of the ground plane.

The invention further relates to an antenna arrangement for a mobile station, comprising an integrated antenna, an antenna ground plane and an antenna raising component arranged to keep the antenna at the right distance from the ground plane.

The invention relates to wireless mobile stations, such as mobile telephones, communicators and corresponding mobile stations. The invention particularly relates to mobile stations comprising an integrated antenna.

2. Brief Description of Related Developments

The progress of electronics and telecommunication technology allows the size and weight of mobile stations to be continuously decreased. Owing to this, mobile stations are increasingly handy and easy to carry along in everyday life. Integrated antennas have replaced external antennas in mobile stations, thus improving the ease of use. An integrated antenna is placed entirely inside the covers of a mobile station, thus not hampering the handling of the telephone. A protruding antenna is known to easily get stuck in clothing, for example. An integrated antenna is also well protected from external loads, impacts and the like, and does therefore not break as easily as an external antenna. Furthermore, antenna technology has developed to a degree that the properties of an integrated antenna can be made sufficiently good. Let is be pointed out that in the present application, the term mobile station refers particularly to mobile telephones and communicators or other telecommunications devices.

The basic shape of an integrated antenna is usually a thin, planar structure having wide boundary dimensions, i.e. what is known as a flat profile antenna. The advantages of such an antenna type include lightness, thinness, ease of installation, adaptability to mass production, and, as a result, low production costs. A flat profile antenna is quite simple to produce as a two-frequency antenna; the interface circuits and wirings can be produced at the same time as the antenna itself.

Between a flat profile antenna—hereinafter referred to as 'antenna'—and the ground plane is an antenna raising component, which keeps the antenna in the right place and at the right height in respect of the ground plane. The raising component is usually made as spacious as possible for it to be as low-loss as possible. The higher the antenna, i.e. the more air-space between the antenna and the ground plane, the broader are the impedance band and radiation efficiency achieved. The significance of height in amplification is low at dot frequency, but owing to the broadening of the impedance band, the amplification of the antenna in the desired band increases. There is certainly often other material than air between an antenna and the ground plane, but owing to the freeness of losses and lightness of the air, as spacious a structure as possible is preferable in said application. Most frequently, the antenna is arranged in a space between the back cover and the circuit board in the mobile station, and its height is maximized according to the height of said space.

Consequently, when the thickness of a mobile station is to be reduced, the height of the antenna has to be reduced, and this raises the resonance frequency of the antenna and impairs the properties of the antenna. Increasing the size of the planar part of an antenna can compensate for the lowering of the antenna, but then the width and/or length of the mobile station have to be increased, which is naturally contradictory to the intention of decreasing the external dimensions of the mobile station.

It is the object of the present invention to provide an antenna arrangement and a mobile station so as to avoid the above drawbacks.

SUMMARY OF THE INVENTION

The mobile station of the invention is characterized in that the antenna, the antenna ground plane and the antenna raising component are arranged in a space shared with a speaker of the mobile station, and that the antenna is substantially higher than the space between a back cover and a circuit board in the mobile station.

The antenna arrangement of the invention is characterized in that the antenna arrangement is arranged in a space shared with a speaker of the mobile station and that the antenna is substantially higher than the space between a back cover and a circuit board in the mobile station.

An essential idea of the invention is that the spaces used by the antenna and speaker of the mobile station are combined and that the antenna is higher than the space between the back cover and the circuit board in the mobile station. Furthermore, it is the idea of a preferred embodiment that the echoing volume of the speaker is substantially convergent with the empty space in the antenna raising component. It is the idea of a second preferred embodiment that the speaker is arranged as close as possible to the front cover of the device. It is an idea of a third preferred embodiment that an antenna circuit board is also arranged in said space. It is an idea of a fourth preferred embodiment that the antenna is a planar inverted F-antenna (PIFA). It is an idea of a fifth preferred embodiment that electronic components, whose circuitries are preferably made by the MID method (Moulded Interconnect Device), are fastened to the antenna raising component. It is the idea of a sixth preferred embodiment that an assembly module is formed from the antenna, the antenna raising component and the speaker.

It is an advantage of the invention that the height of the antenna is not limited to the height of the space between the cover and the circuit board, but substantially the entire height between the front and rear covers of the mobile station can be utilized by the height of the flat profile antenna, whereby an integrated antenna having maximal performance can be arranged within the external dimensions of the mobile station. Furthermore, the echoing volume of the speaker is as large as possible in respect of the external dimensions of the mobile station, whereby its frequency characteristics are better. An antenna circuit board allows the space to be utilized also in the placement of electronic components, which also improves the efficiency of the use of space. When the wirings and components are fastened directly to the antenna raising component, no separate circuit board is needed, and this further decreases the external dimensions and weight of the device, and simplifies the structure and manufacture of the mobile station. An assembly module speeds up the assembly of the mobile station, thus reducing production costs.

BRIEF DESCRIPTION OF THE DRAWINGS

The invention will be described in detail in the attached drawings, in which.

DETAILED DESCRIPTION OF THE PREFERRED EMBODIMENT

Figure 1:
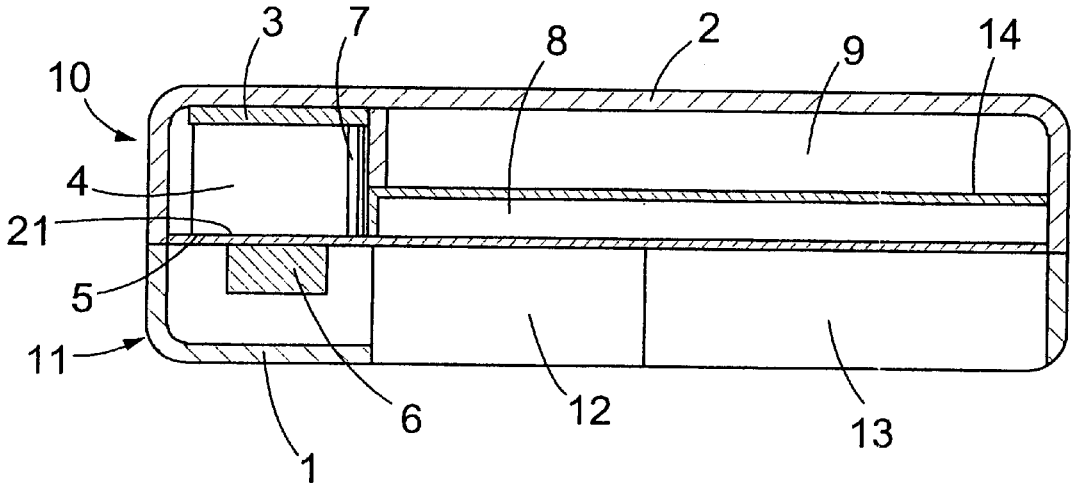
Prior Art Fig. 1
FIG. 1 schematically shows a prior art solution.

FIG. 1 is a schematic side view in partial section of a prior art embodiment of a mobile station. The outer cover of the mobile station comprises a front cover 1 and a back cover 2 joined together, the components of the mobile station being arranged in the space formed by them. In the present application, a front cover 1 refers to that side of the cover of the mobile station where a speaker 6 is arranged, and, correspondingly, a back cover 2 refers to the opposite part of the cover. The mobile station comprises an integrated antenna 3 of the flat profile antenna type. The antenna 3 is arranged in an antenna space 10 between the back cover 2 and a circuit board 5. The antenna 3 is arranged in place close to the back cover 2 by means of an antenna raising component 4. The raising component 4 keeps the antenna 3 in the right place in respect of the mobile station's ground plane 21. Said ground plane 21 is located on the mobile station's circuit board 5, whose length is usually substantially equal to that of the entire device and which divides the device into two longitudinal parts. The speaker 6 is in a speaker space 11 between the circuit board 5 and the front cover 1. In addition to the speaker 6, some other components may be arranged in the speaker space 11. Spaces for a display 12 and a keyboard 13 are arranged between the circuit board 5 and the front cover 1.

As a rule, the electronic components arranged on the circuit board 5 are disposed in a component space 8, but mainly components of the antenna 3 and the speaker 6 are located in that part of the circuit board which is limited by the antenna space 10 and the speaker space 11. An antenna feed 7 connects the antenna 3 to the circuit board. A battery space 9 for the battery of the mobile station is arranged between the circuit board 5 and the back cover 2. A shield 14 separates the battery space 9 and the component space 8.

The structure of the antenna raising component 4 is typically as spacious as possible, providing a maximally loss-free structure. The height of the antenna 3, i.e. the distance from the ground plane disposed on the circuit board 5, is restricted by the height of the antenna space 10 between the circuit board 5 and the back cover 2. Widening the impedance band of the antenna 3 and improving the radiation efficiency by increasing the height of the antenna 3 can only be achieved by increasing the thickness of the mobile station. On the other hand, reducing the external dimensions of the mobile station by reducing the thickness is bound to impair the properties of the antenna 3.

Figure 2:
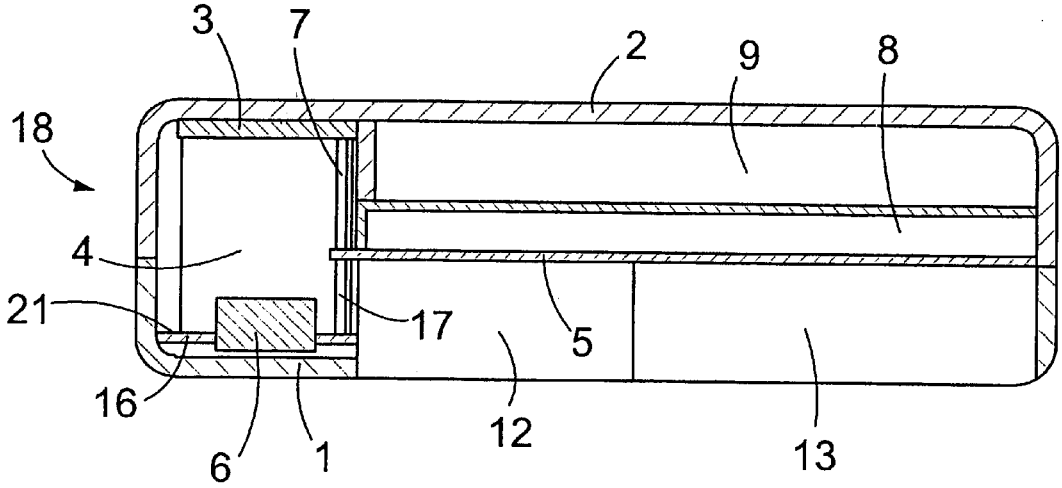
FIG. 2 is a schematic side view in partial section of an embodiment of the mobile station of the invention.

FIG. 2 is a schematic side view in partial section of an embodiment of the mobile station of the invention. Let it be pointed out that the dimensions of the mobile stations and their components shown in FIGS. 1 to 4 are only exemplary and have been chosen to clarify the description; the antenna, for example, is typically an extremely thin component. The basic structure of the mobile station is similar to that of the prior art mobile station shown in FIG. 1, except for the antenna arrangement. The antenna space 10 and the speaker space 11 are integrated into a shared space 18 extending from the front cover 1 to the back cover 2 and comprising the antenna 3, the antenna raising component 4 and the speaker 6. In other words, the circuit board 5 is arranged so short that it does not extend between the antenna 3 and the speaker 6. The shared space 18 also comprises an antenna circuit board 16 to which electronic components and wirings are fastened, but which are not shown in the figure for the sake of clarity. The antenna circuit board 16 also comprises an antenna ground plane 21. The antenna circuit board is arranged to be almost in contact with the front cover 1, whereby the antenna 3 is substantially higher than in the prior art mobile station shown in FIG. 1, whose thickness is exactly the same. Thus, the properties of the antenna 3 of the mobile station of the invention are substantially better. On the other hand, the thickness of the mobile station of the invention can be reduced in respect of the prior art mobile station without impairing the properties of the antenna 3.

The speaker 6 is fastened to the antenna circuit board 16 and arranged as close as possible to the front cover 1: only a small space remains between the front cover 1 and the speaker 6, in which the speaker diaphragm can freely oscillate. The speaker 6 utilizes the empty space in the antenna raising component as the echoing volume. Since the echoing volume thus formed is significantly larger than in a prior art mobile station, the frequency characteristics of the speaker 6 are exceptionally good.

The antenna circuit board 16 is connected to the circuit board 5 with a conductor 17, which is for example a flat cable or a flex type of flexible conductor, such as a diaphragm-like flexible printed board made from polyamide. An alternative is to use what is known as a flexible conductor cable composed of a flexible base material and conductors on the surface thereof.

The type of the antenna 3 is PIFA, but the invention can very well be applied to for example a Meander antenna, a microstrip antenna, a patch antenna, a fractal antenna or another corresponding flat profile antenna.

Figure 3:
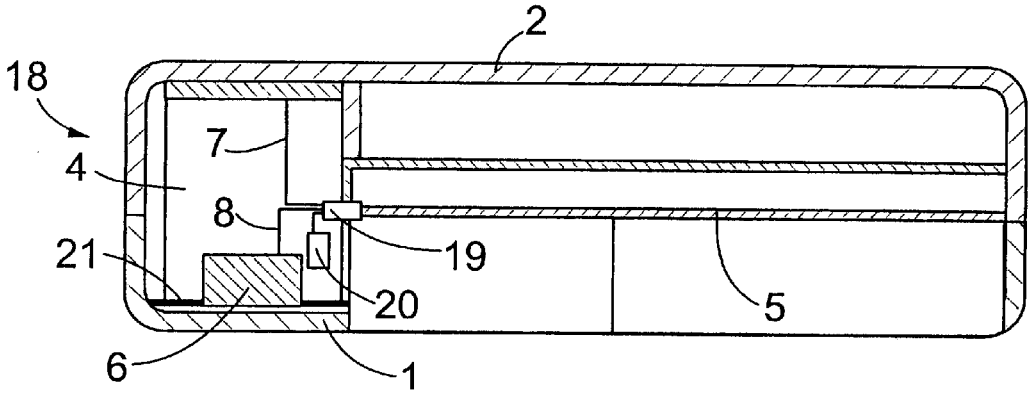
FIG. 3 is a schematic side view in partial section of a second embodiment of the mobile station of the invention.

FIG. 3 is a schematic side view in partial section of a second embodiment of the mobile station of the invention. This embodiment comprises no antenna circuit board. Instead, antenna 3 and speaker wirings 7 and 8 are arranged directly in the antenna raising component 4. The wirings can be implemented for example by the MID (Moulded Interconnect Device) technology, electrolytic coating or another technology known per se and suited to the making of metal coatings for plastic parts. Other electronic components 20 can also be arranged in the raising component 4 and their circuitries are made in the same way as the antenna and speaker wirings 7 and 8. The wirings 7 and 8 are connected via a connector 19 to the circuit board 5.

The antenna ground plane 21 is arranged close to the front cover 1 so as to maximize the height of the antenna 3 in respect of the thickness of the mobile station.

Figure 4:
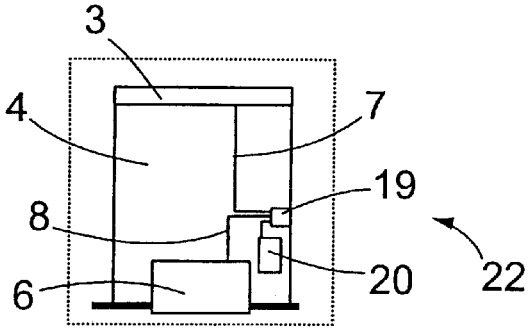
FIG. 4 is a schematic side view in partial section of an embodiment of the antenna arrangement according to the invention.

FIG. 4 is a schematic side view in partial section of an embodiment of the antenna arrangement according to the invention. The antenna arrangement forms an assembly module 22 comprising an antenna 3, an antenna raising component 4, a speaker 6, antenna 3 and speaker 6 wirings, optionally other components, and necessary connectors 19 via which the module is connected to necessary electronic components of a mobile station. The assembly module 22 can naturally also comprise an antenna circuit board 16. In addition, the assembly module 22 comprises necessary fastening means for fastening the module to the rest of the body and/or cover parts 1, 2 of the mobile station. The assembly module 22 allows said components to be arranged simultaneously and rapidly in place in the mobile station. Thus, the assembly module 22 simplifies and speeds up the final assembly of the mobile station.

The drawings and the related description are only intended to illustrate the idea of the invention. The details of the invention may vary within the scope of the claims.

What is claimed is:

1. A mobile station having an integrated antenna assembly including, an antenna ground plane an antenna, and an antenna raising component arranged to keep the antenna at a determined height in respect of the ground plane, said mobile station comprising:

a front cover and back cover which define an overall space there between, an antenna assembly space defined as part of said overall space, wherein said antenna assembly is mounted, said space extending from said front cover to said back cover;

a main circuit board space defined as part of said overall space separate from said antenna assembly space, wherein a main printed circuit board is mounted at a predetermined height from said back cover; and wherein a speaker of the mobile station is also mounted in said antenna assembly space, and wherein said printed circuit board does not extend into said antenna assembly space.

2. A mobile station as claimed in claim 1, wherein said antenna assembly space is arranged to constitute an echoing volume for the speaker.

3. A mobile station as claimed claim 1, wherein the type of the antenna is PIFA.

4. A mobile station as claimed claim 1, wherein conductors or electronic components are fastened to the antenna raising component.

5. A mobile station as claimed in claim 1, wherein an antenna circuit board is arranged in said antenna assembly space.

6. An antenna arrangement for a mobile station, comprising an integrated antenna, an antenna ground plane and an antenna elevation piece arranged to keep the antenna at a determined height from the ground plane, wherein the antenna arrangement is arranged in a space shared with a speaker of the mobile station, and a circuit board is mounted in the mobile station such that it does not extend into said space.

7. An antenna arrangement as claimed in claim 6, wherein the antenna arrangement is arranged as an assembly module.

* * * * *